United States Patent [19]

Steiner et al.

[11] 4,146,187

[45] Mar. 27, 1979

[54] DEVICE FOR INITIATING WRAPPING OF WEBS ONTO EMPTY REELS

[75] Inventors: Karl Steiner; Günter Rohde, both of Heidenheim, Fed. Rep. of Germany

[73] Assignee: J. M. Voith GmbH, Heidenheim, Fed. Rep. of Germany

[21] Appl. No.: 871,929

[22] Filed: Jan. 24, 1978

[30] Foreign Application Priority Data

Feb. 11, 1977 [DE] Fed. Rep. of Germany ..... 2705776

[51] Int. Cl.[2] ..... B65H 19/20

[52] U.S. Cl. ..... 242/56 R; 242/65

[58] Field of Search ..... 242/56 A, 56 R, 65

[56] References Cited

U.S. PATENT DOCUMENTS

| | | | |
|---|---|---|---|
| 3,365,141 | 1/1968 | Soloduk | 242/65 X |
| 3,471,097 | 10/1969 | Phelps | 242/56 R |
| 3,889,892 | 6/1975 | McLead | 242/65 X |

*Primary Examiner*—Edward J. McCarthy

*Attorney, Agent, or Firm*—Ostrolenk, Faber, Gerb & Soffen

[57] ABSTRACT

A web passes over a drive roller onto a reel which becomes fully wound; the full reel is moved away from the drive roller; an empty reel engages the drive roller; a web shifting element lifts the web, in a direction counter to the rotation direction of the drive roller, to form a loop that wraps around the empty reel; a transport element may upraise the web at the other side of the drive roller so that the web loop may enter either the nip defined between the web and the empty reel with the web upraised or the nip between the empty reel and the drive roller with the transport element down; the web shifting element and/or the transport element may include an air cushioning device for the web.

22 Claims, 5 Drawing Figures

Fig. 4
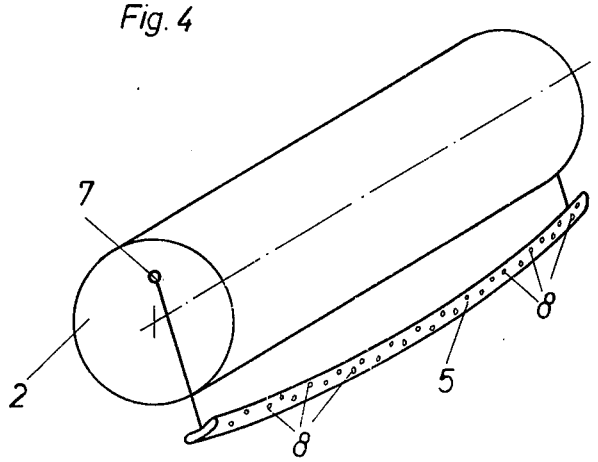
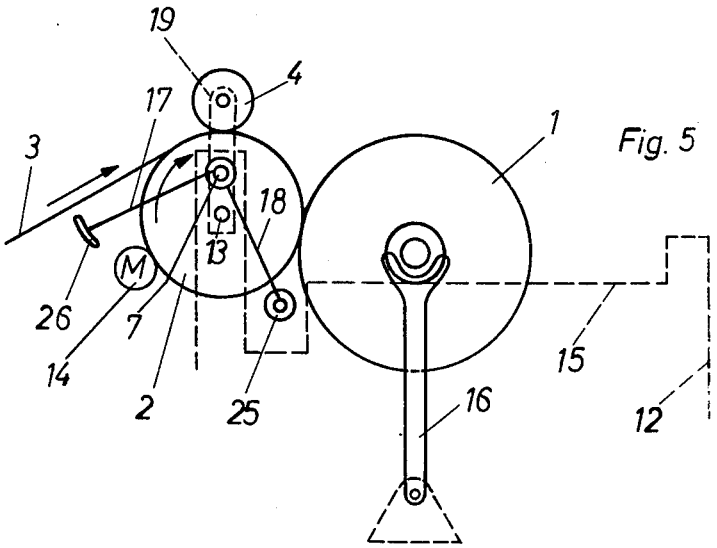
Fig. 5

DEVICE FOR INITIATING WRAPPING OF WEBS ONTO EMPTY REELS

BACKGROUND OF THE INVENTION

The present invention relates to a device for the continuous wrapping of webs, and particularly paper webs, onto a succession of empty reels without interruption of the web feeding.

Web wrapping devices feed a continuous supply of web material, such as paper, for being wrapped around a succession of empty reels. When one reel is fully wound, the continuous web is then transferred to and wound onto the next empty reel. The invention concerns a web wrapping device which enables such transfer of the web without any interruption in the continuous feeding of web material and without any damage to the web.

In known wrapping devices, shown, for example, in German Published Specification DT-OS No. 24 23 021 and U.S. Pat. No. 3,841,578, when one reel has been fully wound, it is disengaged from the means which winds the web onto it. The next empty reel is driven to rotate and the web is thereafter wound about the empty reel. Often, during the transfer of the winding from the full reel to the empty reel, while the web is still attached to the full reel, the web breaks as it is first being applied to the empty reel lying in the ready position. These difficulties increase in proportion to increasing web velocity.

SUMMARY OF THE INVENTION

It is the primary object of the invention to minimize damage to or breakage of a web while the winding of the web on a fully wound reel is being terminated and winding of the web on an empty reel is being started, i.e. during web transfer.

It is another object of the invention to effectively transfer the winding of a web from a fully wound reel to another empty reel.

It is a further object of the invention to effect such transfer without applying great tension to the web.

It is yet another object of the invention to effect such web transfer while the web is operating continuously and also when the web is moving at relatively great velocity.

It is a further object of the invention to provide a loop of web material for being engaged by the empty reel for starting web winding thereon.

According to the invention, the reels on which a web is to be wound are held in engagement with a driving roller which rotates the reels. Once the web has been wound on one reel, the fully wound reel is shifted away from contact with the driving roller while the empty reel remains in engagement with the driving roller.

A web shifting device moves the web to wrap around the empty reel. The web shifting device moves the web around the empty reel by forming a loop of web above the empty reel, i.e. a loop that passes around the side of the empty reel that is away from the driving roller. The web shifting device moves the web and the resulting loop in a direction opposite to the direction in which the driving roller is rotating, which is also the direction in which the empty reel is being rotated by the driving roller. The web shifting device comprises a web shifting element that moves between the driving roller and the spaced away fully wound roller in the direction counter to the direction of rotation of the driving roller. Eventually, the web shifting device moves the loop of the web far enough around the empty reel so that the web is caught in the nip or entry slot between the empty reel and the driving roller. The web is thereafter drawn between the empty reel and the driving roller, and is wound about the empty reel. After the web has begun being wound about the empty reel, it is cut so as to separate the continuous web from the now fully wound reel.

In the preferred embodiment of the invention, the web shifting device comprises a pivotable element that pivots from beneath the fully wound reel, between the fully wound reel and the driving roller, and up toward the empty reel. The web shifting element applies force against the side of the web that had just been in contact with the driving roller and that will be out of contact with the empty reel. Eventually, the web shifting device will have pivoted the web loop enough for the web to be engaged in the nip of the empty reel. The web shifting element is pivoted in a direction opposite to the direction in which the driving roller rotates, and this is also the same direction as the driven empty reel rotates, and the shifting element is pivoted into a position approximately above the empty reel so that the empty reel lies between the web shifting element and the driving roller. This placement of the elements makes it possible to select web loops of optimum size and form and position, as compared with known web transfer devices. The loop developed by the device of the invention can be safely introduced into the nip of the empty reel without breaking the web.

In one embodiment of the invention, the loop of web material is wrapped completely around the circumference of the empty reel before it enters the nip of the empty reel. However, in accordance with a further development of the invention, the extent that the loop of the web must wrap around the circumference of the empty reel before the web loop is introduced into the nip of the empty reel may be less than the entire circumference of that reel. One technique for controlling the extent to which the web loop must wrap around the empty reel comprises moving a web transport device, which is apart from the web shifting device, against the web at the side of the empty reel that is opposite the side thereof past which the web shifting device moves. The web thus passes the web transport device before the web first meets the empty reel. The extent to which the web transport device lifts the web away from the drive roller and wraps it around the side of the empty reel away from the web shifting device correspondingly decreases the circumferential length of the surface of the empty reel around which the web shifting device must move the web loop. The web shifting device shifts the loop of the web around the empty reel until the loop is engaged in the nip defined between the empty reel, on the one hand, and the length of web material passing from the transport device toward the empty reel, on the other hand. Without the transport device or other means for decreasing the extent to which the web loop must wrap around the empty reel, the web loop is drawn into the nip between the empty reel and the driving roller. With the transport device or other similar lifting means, on the other hand, the web loop is first drawn into the nip between the empty reel and the length of web prior to the nip defined between the driving roller and the empty reel. It has been found that for optimum effective operation, the loop of the web should wrap around the empty reel at least 60° before being drawn into a nip defined at the empty reel.

The web passes from a continuous web supply, past the transport device, if one is used, and into the nip between the empty reel and the driving roller. The web loop is first formed at the exit of the web from between the empty reel and the driving roller. The web loop is then shifted around the empty reel until it again enters the nip thereof. Thus, the web is transported around the empty reel by the empty reel itself and by the length of the web that first enters the nip (and which thereafter exits to form the loop). The web is not therefore for the first time being drawn to and wrapped around the empty reel at the entry nip to the empty reel itself. A further advantage of shifting and looping the web around the empty reel before the web is introduced into the nip at the empty reel is that the web loop has covered a relatively wide circumferential pathway around the empty reel. Therefore, when the web loop is grabbed by the empty reel at the nip, the loop can take up the initial pull on the looped web and prevent its being torn.

Furthermore, since the web has already been appropriately looped or curved by the device of the invention, thicker webs can be looped around the empty reel more easily than with known web wrapping apparatus.

Other objects and features of the invention will become apparent from the following description of a preferred embodiment of the invention taken in conjunction with the accompanying drawings.

BRIEF DESCRIPTION OF THE DRAWINGS

FIG. 4 is a schematic perspective view of the driving roller and transfer device of the invention; and FIG. 5 shows a modification of the device of the invention.

DESCRIPTION OF THE PREFERRED EMBODIMENT

Figure 1:
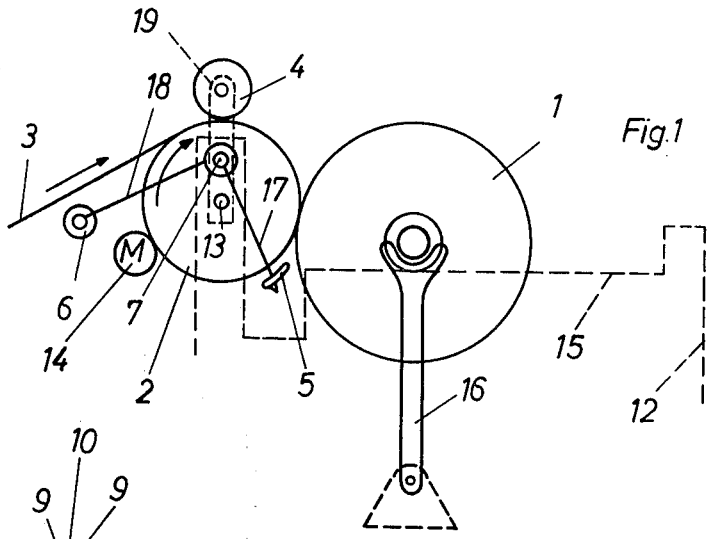
FIG. 1 is a schematic side view of a device in accordance with the invention.

The web transfer device of the present invention shown in FIG. 1 includes a power driven web and reel driving roller 2, which is fixedly located on the main support base 12 and rotatable on its axle 13. A motor 14 conventionally drives the roller 2 to rotate as the arrow shows. A web 3 runs from a continuous supply (not shown) and the web 3 is driven, in the direction of the arrow, by roller 2. A previously wound full reel 1 on which web 3 has been wound is shown in FIG. 1 as being in surface contact with the driving roller 2. The reel 1 is carried on the horizontal bed 15 of the base support 12. An arm 16 connected with an appropriate linkage is adapted to engage the reel 1 and move it away from the driving roller 2, as described below. With the reel 1 in contact with the roller 2, rotation of the roller 2 clockwise in the direction of the arrow rotates the full reel 1 counterclockwise.

Atop the driving roller 2 and angularly spaced away around the driving roller 2 from the full reel 1 is positioned and held an empty reel 4 which is also in driving surface engagement with the web 3. Support means 19, which may be connected to the support 12, holds the empty reel 4 in place. Rotation of the driving roller 2 draws the web 3 into the nip defined between the driving roller 2 and the empty reel 4 and such movement of the web 3 rotates the empty reel 4 counterclockwise in FIG. 1.

The device includes the support base 12 on which the full reel 1 is supported and along which the full reel is movable by arms 16 away from the driving roller 2 for reasons described below. The support 12 also supports the driving roller 2 in the stationary position for rotation about its central axle 13. Further, the support 12 defines a common pivot axle 7 between the axis of the roller 2 and the empty reel 4. The axle 7 extends parallel to the roller 2.

There is a web shifting device 5 that includes a support arm 17, which extends between the shifting device 5 and the axle 7. The device 5 and its support arm 17 are pivotable about the axle 7. The web shifting device is normally positioned at the exit side of the line along which the driving roller 2 and the full reel 1 are in engagement. This positions the web shifting device to apply force to the web on the side or surface of the web that is out of engagement with the reels 1 and 4 and also at that side of the driving roller 2 such that the web shifting device 5 will move between the driving roller 2 and the full reel 1 when the web shifting device is operated.

There is also a web transporting device 6 which is positioned to be engageable with the side of the web that is out of contact with the empty reel 4 and which engages the portion of the web 3 before it first contacts the driving roller 2 and the empty reel 4. The web transport device 6 also comprises a support arm 18 that is pivotally carried on the pivot axle 7, whereby the web transport device 5 pivots between its various below described positions.

In FIG. 1, both the web shifting device 5 and the transport device 6 are in their starting positions before they both engage the side of the web that faces away from the empty reel 4. The web shifting device 5 can be pivoted, together with the section of the web 3 that device 5 moves around the common axle 7 and in the direction that is counter to the direction of rotation of the driving roller 2 and which is in the same direction of rotation of the empty reel 4. The transport device can be pivoted around the axle 7 in a direction that is the same clockwise pivot direction as the driving roller 2.

Although the web shifting device 5 and the transport element 6 are shown as being pivotable about an axle 7, other embodiments are contemplated wherein the devices 5 and 6 travel over more straight line paths, represented by x and y coordinates.

Figure 2:
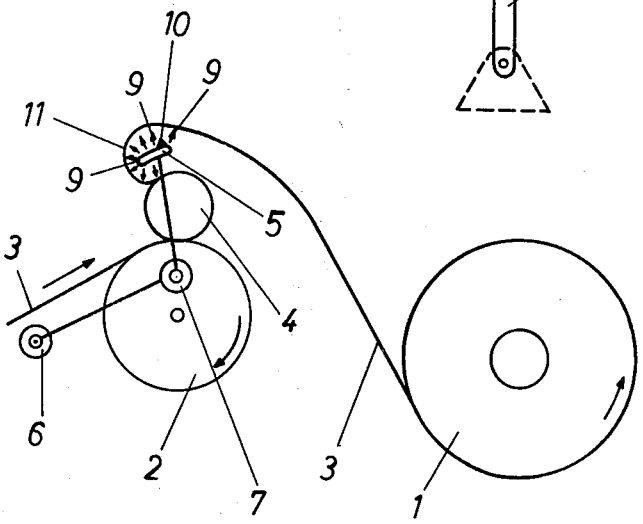
FIG. 2 schematically illustrates the same device in one web transferring operation.
Figure 3:
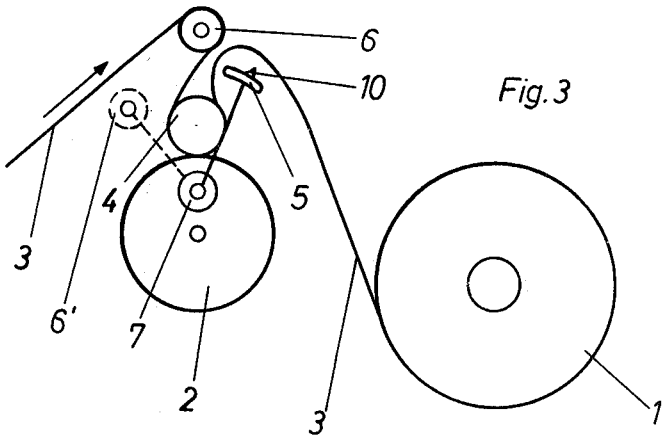
FIG. 3 schematically illustrates the device in another web transferring operation.

Each of the elements of the devices 5 and 6 may either be in the form of a freely rotatable roller supported on a support shaft, which is the form illustrated for the transport element 6, in FIGS. 1–3, or it may be in the form of a laterally extending rod, which is the form illustrated for the shifting element of the web shifting device 5. Both the rotatable roller and the rod have respective axial lengths that are substantially the same as the width of the web 3. Furthermore, they extend parallel to the axle 13 of roller 2. The alternate embodiment of FIG. 5 differs from the first embodiment only in that the web shifting device 25 is in the form of a roller (like roller 6) and the transport device 26 is in the form of a rod (like rod 5).

When a rod is used for either of the devices 5 and 6, it may be provided with an air valve or air cushion operating means around its periphery, which is comprised of a plurality of openings arrayed along that surface of the rod which will oppose the web, generally the convex exterior of the rod. Air emerging from the openings, in air currents represented by the arrows 9 in FIG. 2, forms an air cushion that separates the web from the rod like element, while permitting the rod like element to move or pivot so as to shift or transport the web as a particular arrangement requires. As shown in FIG. 2, when the shifting element of the web shifting device 5 is in the form of a rod, it is especially desirable that the air release openings thereof be aimed to blow air both radially outwardly against the web 3 and also radially inwardly toward the roller 2 and toward the empty reel 4 and finally so as to blow air in the direction in which the web shifting device pivots, which is opposite to the direction in which the roller 2 operates. As shown in FIG. 2, when the web shifting device 5 pivots up from the position of FIG. 1 to the position of FIG. 2, it shifts and applies air beneath the web 3 in front of it. The resulting air cushion forces the web 3 to be wound against the empty reel 4, blows the web 3 against the surface of the reel 4 for tight winding and helps move the web so that it can be engaged in the nip of the empty reel.

The shifting element of the web shifting device 5 is shown in greater detail in FIG. 4. The shifting element is a curvedly shaped rod, curved around an axis selected so that the shifting element is convex on its exterior and in relation to roller 2. This helps strengthen the shifting element and also helps keep the web portion looping around the shifting element from becoming wrinkled. If the transport element 6 is similarly a rod rather than a roller, it also may be axially convex in the same manner as the shifting element of the web shifting device 5.

The shifting element of the web shifting device 5 is also provided on its radially exterior surface with a cutter blade 10 that cuts off the web 3 after the loop 11 of the web has entered the nip of the empty reel because the length of the web 3 still attached to the full reel 1 is thereafter drawn tightly against the shifting element of the web shifting device 5 which enables the cutter blade 10 to easily cut through the web.

Even if both of the shifting element of the web shifting device 5 and the transport element 6 are merely freely rotatable rollers, it is still desirable for them to be provided with air valves of the type shown in greater detail in FIG. 4 because the emerging air effectively prevents friction between the respective element and the web passing thereby, easing the transport of the web in the desired direction.

Within the contemplation of the present invention, instead of the web shifting device 5 comprising an actual shiftable element, the web shifting device may be comprised of various air pressure supplying means, which supply sufficient pressure at appropriate locations to form the same loop 11 in the web 3 that is shown in FIGS. 2 or 3.

Comparing FIGS. 1 and 2, in FIG. 2, the finished wound reel 1 has been separated from the drive roller 2 along the horizontal bed of the support 12 of the machine. The shifting element of the shifting device 5 can thus be pivoted upwardly, as is shown in the comparison of FIGS. 1 and 2, in the direction opposite to that in which the reel 2 is rotating and into a position approximately above the empty reel 4 and on the opposite side of the empty reel 4 from the drive roller 2. The shifting element moves the web 3 around the empty reel 4 on the air cushion 9 and the air cushion keeps the web 3 separate from the shifting element of the web shifting device 5. The web shifting device 5 and its air cushion 9 form and define the rounded loop 11 of the web 3. The loop 11, as a result of its own weight and as a result of additional force supplied inside it by the air cushion 9, falls back around and wraps around the empty reel 4. Eventually, the shifting of the web shifting device 5 and the air cushion 9, coupled with the rotation of the empty reel 4, force the loop to enter the nip between the empty reel 4 and the driving roller 2. Further rotation of the driving roller 2 once the web 3 has entered the nip continues the winding of the web around the empty reel 4. This winding also tightens the section of the web 3 between the shifting device 5 and the full reel 1 which is not now rotating, resulting in the cutting of the web by the cutter blade 10.

With reference to FIG. 3, the web loop engaging procedure is even more effective when the transport element 6 is operated by being pivoted upwardly from its position of FIG. 1 in the same direction as the driving roller 2 is rotated. The transport element is pivoted to a position in front of and above the entry nip of the driving roller 2 and the empty reel 4 and to a position that is approximately above the reel 4 and on the side of the reel 4 opposite the side thereof engaged by the driving roller 2. This movement of the transport element 6 places the entry nip for the loop 11 between the empty reel 4 on one side and the upraised segment of web 3 on the other side, instead of the entry nip for the loop being at the line of contact between the empty reel 4 and the driving roller 2. The earlier point of engagement of the loop and the first engagement of the loop by the more flexible portion of the web 3 rather than by the rigid roller 2, insures a more effective transfer of web winding with less danger of web tearing.

In the illustrated embodiment, the transport element is pivoted into a position that is almost on the same radius as the roller 2 and the shifting element 5 above it. In an alternate embodiment, the transport element can be pivoted only to a position opposite that of the shifting element 5, as shown by the transport element 6' drawn in broken lines in FIG. 3. The position of the transport element 6 with respect to the position of the shifting device 5 will determine the arcuate distance which the loop 11 must be wrapped around the empty reel 4 before the loop is engaged by the empty reel and enters the nip of the empty reel. In the preferred version, the loop 11 should wrap over at least 60° around the exterior of the reel 4 before it meets the nip defined at the meeting between the upraised section of the web 3 and the empty reel 4.

No matter which technique is used for shifting the web 3, e.g. whether the illustrated web shifting device 5 is used, or whether other web loop forming web shifting devices are used, either of the transport elements 6 or 6' can be used or not, as desired. Similarly, depending upon the particular wrapping procedure used and the type of web to be wrapped, either or both of the elements 5 or 6 may be pivoted up to a position above the center of the empty reel, effectively the position of these elements in FIG. 3.

In the foregoing the present invention has been described solely in connection with preferred illustrative embodiments thereof. Since many variations and modifications of the present invention will now be apparent to those skilled in the art, it is preferred that the scope of the invention be determined not by the specific disclosures herein contained but only by the appended claims.

We claim:

1. Device for wrapping of a continuous web onto a plurality of reels in succession and for transferring the wrapping of the web from a first reel onto a second reel; said device comprising:

a drive roller having an axis and means for rotating said drive roller around its said axis;

first support means for supporting a first reel for enabling the first reel to rotate;

a second reel; second support means for supporting said second reel at a position such that rotation of said drive roller in one direction rotates said second reel in the opposite direction and said second reel being supported so as to meet said drive roller to define an entrance nip into which the continuous web would be drawn by the rotation of said drive roller and said second reel, and said nip being defined at one side of second reel and said drive roller, whereby a continuous web may pass between said drive roller and said second reel from said nip and the web thereafter may extend to the first reel;

a web shifting element normally positioned at the side surface of the web that is away from the side surface of the web that is to be wrapped around said second reel, said web shifting element comprising means for raising the web toward said second reel, for forming a loop in the web as it is being raised and for moving and wrapping the web loop around said second reel and the loop of the web being wrapped around said second reel far enough eventually to enter said nip and pass between said second reel and said drive roller; said web shifting element raising the web in a direction contrary to the direction of rotation of said drive roller;

a web transport device for engaging the portion of the web before the web passes through said nip and said web transport device being for upraising that portion of the web to partially wrap it around said second reel, thereby to move that portion of the web around said second reel to define a second entrance nip between the upraised web portion and the second reel and said second nip being away from the first said nip whereby the loop of the web is engaged in said second nip and the web at the loop thereof is only thereafter engaged by the first said nip.

2. Device for wrapping of a continuous web onto a plurality of reels in succession and for transferring the wrapping of the web from a first reel onto a second reel; said device comprising:

a drive roller having an axis and means for rotating said drive roller around its said axis;

first support means for supporting a first reel for enabling said first reel to rotate;

a second reel, second support means for supporting said second reel at a position such that rotation of said drive roller in one direction rotates said second reel in the opposite direction and said second reel being supported so as to meet said drive roller to define an entrance nip into which the continuous web would be drawn by the rotation of said drive roller and said second reel and said nip being defined at one side of second reel and said drive roller, whereby a continuous web may pass between said drive roller and said second reel from said entrance nip and the web thereafter may extend to the first reel;

a web shifting device, including a web shifting element that is normally positioned at the side surface of the web that is away from the side surface of the web that is to be wrapped around said second reel; said web shifting element being movable past said drive roller, between said drive roller and the first reel, for raising the web toward said second roll for forming a loop in the web as it is being raised and for moving and wrapping the web loop around said second reel and the loop of the web being wrapped around said second reel far enough eventually to enter said nip and pass between said second reel and said drive roller; said web shifting element being moveable for raising the web along a path in a direction contrary to the direction of rotation of said drive roller.

3. The device of claim 2, wherein said web shifting element is moveable along said path into a position approximately above said second reel such that with said web shifting element upraised, said second reel lies generally between said web shifting element and said drive roller.

4. The device of claim 3, further comprising a web transport device which comprises a transport element positioned to engage the portion of the web before the web passes through said nip; said transport element being moveable in a direction up toward said second reel for upraising that portion of the web to partially wrap it around said second reel, thereby to move that portion of the web around said second reel to define a second entrance nip between the upraised web portion and the second reel; said second nip being away from the first said nip, whereby the loop of the web is engaged in said second nip and the web at the loop thereof is only thereafter engaged by the first said nip.

5. The device of claim 4, wherein said transport element upraises the portion of the web around said second reel a distance short enough such that the web loop wraps around said second reel at least 60° before entering said second nip.

6. The device of claim 3, wherein said web shifting element comprises air cushion creating means that direct air currents in directions away from said drive roller and away from said second reel and which air currents are aimed to blow the web loop before said shifting element as said shifting element shifts along said path.

7. The device of claim 2, wherein said first support means supports said first reel adjacent to said driving roller for causing rotation of said first reel through engagement with and rotation of said driving roller; said first supporting means including means for moving said first reel away from said driving roller, thereby to halt driving of said first reel and to create a space through which said web shifting element may pass along said path between said first reel and said driving roller.

8. The device of claim 2, wherein said web shifting device further comprises a support; said web shifting element being pivotally carried on said web shifting device support for pivotal moving of said web shifting element along said pathway.

9. The device of claim 2, wherein said web shifting element has a length thereof that extends generally across the entire width of the web being wound.

10. The device of claim 9, wherein said web shifting element comprises a freely rotating cylinder; said web shifting device comprises a support for said cylinder which holds said cylinder for extension along an axis parallel to the axis of said drive roller and which moves said cylinder along said path.

11. The device of claim 10, wherein said web shifting device further comprises a support; said web shifting element being pivotally carried on said web shifting device support for pivotal moving of said web shifting element along said path.

12. The device of claim 9, wherein said web shifting element comprises a rod; said web shifting device comprises a support for said rod which holds said rod for extension along an axis parallel to said drive roller and which moves said rod along said path.

said rod having an outwardly facing surface which faces outwardly on the side thereof away from said drive roller and which is convexly curved on said outwardly facing surface.

13. The device of claim 12, wherein said web shifting device further comprises a support; said web shifting element being pivotally carried on said web shifting device support for pivotal moving of said web shifting element along said path.

14. The device of claim 12, wherein said web shifting element comprises air cushion creating means that direct air currents in directions away from said drive roller and away from said second reel and which air currents are aimed to blow the web loop before said shifting element as said shifting element shifts along said path.

15. The device of claim 2, wherein said web shifting element comprises air cushion creating means that direct air currents in directions away from said drive roller and from said second reel and which air currents are aimed to blow the web loop before said shifting element as said shifting element shifts along said path.

16. The device of claim 2, further comprising a web transport device which comprises a transport element positioned to engage the portion of the web before the web passes through said nip; said transport element being moveable in a direction up toward said second reel for upraising that portion of the web to partially wrap it around said second reel, thereby to move that portion of the web around said second reel to define a second entrance nip between the upraised web portion and the second reel said second nip being away from the first said nip, whereby the loop of the web is engaged in said second nip and the web at the loop thereof is only thereafter engaged by the first said nip.

17. The device of claim 16, wherein said transport device comprises a support and said transport element is pivotally carried on said transport device support for moving in a direction up toward said second reel.

18. The device of claim 16, wherein said transport element has a length thereof that extends generally across the entire width of the web being wound.

19. The device of claim 18, wherein said web transport element comprises a freely rotating cylinder; said web transport device comprises a support for said cylinder which holds said cylinder for extension along an axis parallel to the axis of said drive roller and which moves said cylinder in said direction toward said second reel.

20. The device of claim 18, wherein said transport element comprises a rod; said web shifting device comprises a support for said rod which holds said rod for extension along an axis parallel to said drive roller and which move said rod along in said direction toward said second reel.

21. The device of claim 18, wherein said web transport element includes air cushion release means that direct air currents outwardly therefrom so as to create an air cushion around said web transport element for separating the web from said transport element.

22. The device of claim 16, wherein said transport element upraises the portion of the web around said second reel a distance short enough such that the web loop wraps around said second reel at least 60° before entering said second nip.

* * * * *